United States Patent [19]

Magee et al.

[11] Patent Number: 4,627,499

[45] Date of Patent: Dec. 9, 1986

[54] MOBILE DRILLING MACHINE

[76] Inventors: William E. Magee, 155 Shevlin Rd., Novato, Calif. 94947; Michael Geister, 64 Rock Rd., Kentfield, Calif. 94914; John N. Dillenburg, Jr., 1249 Leafwood Heights, Novato, Calif. 94947

[21] Appl. No.: 604,746

[22] Filed: Apr. 27, 1984

[51] Int. Cl.[4] ..... E21B 15/04

[52] U.S. Cl. ..... 173/43; 173/44; 173/27; 414/79

[58] Field of Search ..... 173/43, 44, 42, 27, 173/22, 39; 414/719

[56] References Cited

U.S. PATENT DOCUMENTS

| | | | |
|---|---|---|---|
| 2,746,612 | 7/1952 | Wirz . | |
| 2,991,891 | 2/1958 | Wills . | |
| 3,227,295 | 12/1964 | Hamilton et al. . | |
| 3,529,679 | 9/1970 | Leven | 173/43 X |
| 3,800,965 | 4/1974 | Barron et al. . | |
| 3,912,096 | 10/1975 | Carpenter | 414/719 |
| 3,919,816 | 11/1975 | Ranft | 173/43 X |
| 3,960,285 | 6/1976 | Gano . | |
| 4,032,016 | 6/1977 | Grat | 414/719 |
| 4,230,372 | 10/1980 | Marten | 173/43 X |
| 4,310,098 | 1/1982 | Dirkesen . | |

*Primary Examiner*—E. R. Kazenske
*Assistant Examiner*—Willmon Fridie, Jr.
*Attorney, Agent, or Firm*—John A. Bucher

[57] ABSTRACT

A heavy duty, mobile drilling machine is disclosed based on a track type vehicle having a rotatable turntable, an operator station and other vehicle machinery being arranged along opposite sides of the turntable to form a central open channel, a boom being pivotably connected to the turntable and arranged in the channel, the boom being of a telescoping type having an extendable and retractable portion forming a chamber for receiving water or other ballast, a drill implement being mounted on a forward end of the extendable boom portion by relative transverse pivots with respective motors or jacks providing for 360° adjustment of the drill implement, the telescoping nature of the boom and the other controls for the drilling implement, boom and turntable permitting use of the drilling implement in a wide variety of operating positions. The drilling implement is also movable into a position parallel with the boom, the central channel in the turntable being adapted for receiving the boom and mast so that the overall dimensions of the mobile drilling machine permit transport to different operating sites without requiring disassembly.

9 Claims, 7 Drawing Figures

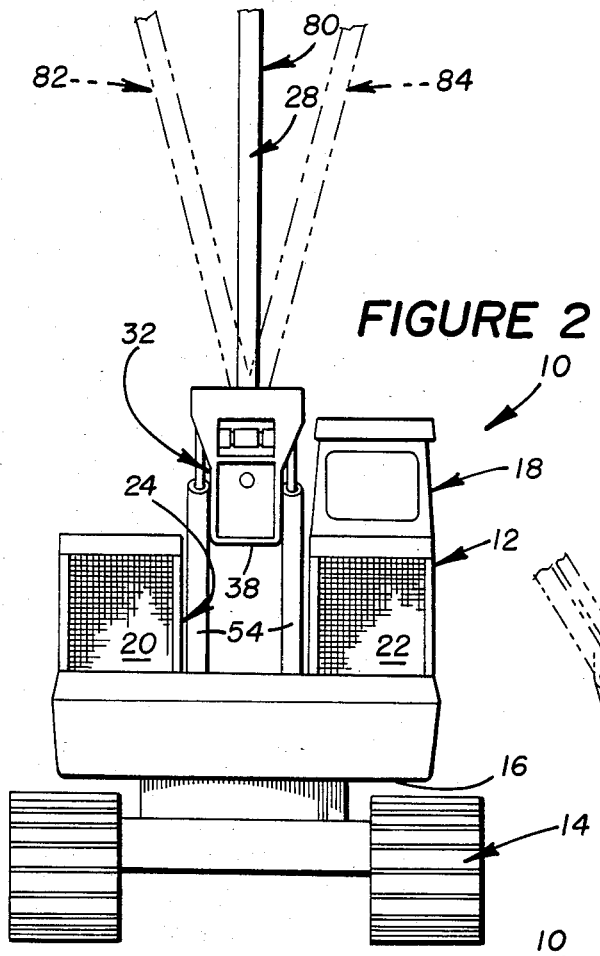
FIGURE 2
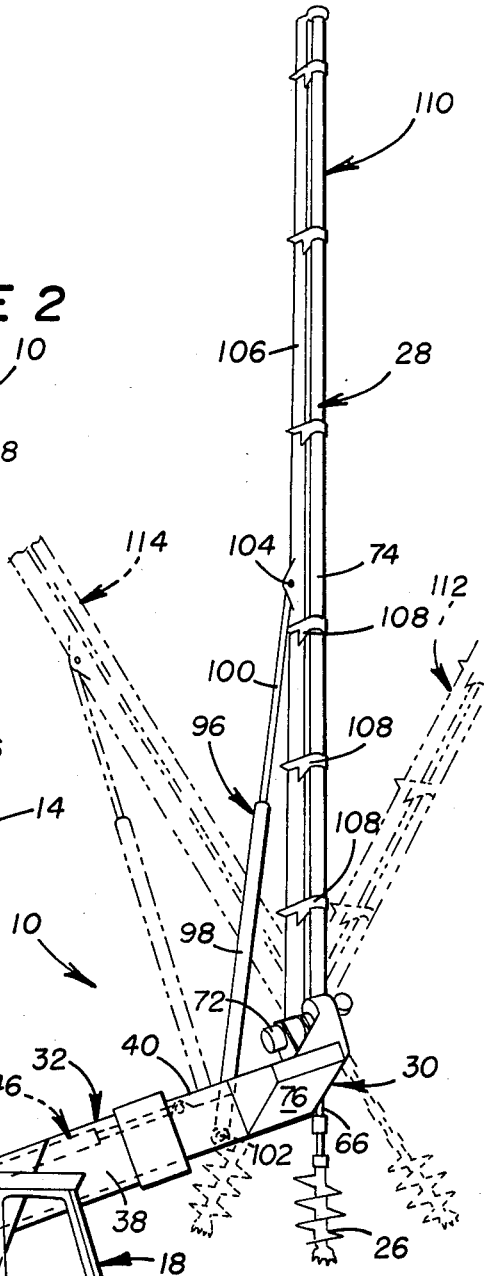
FIGURE 1
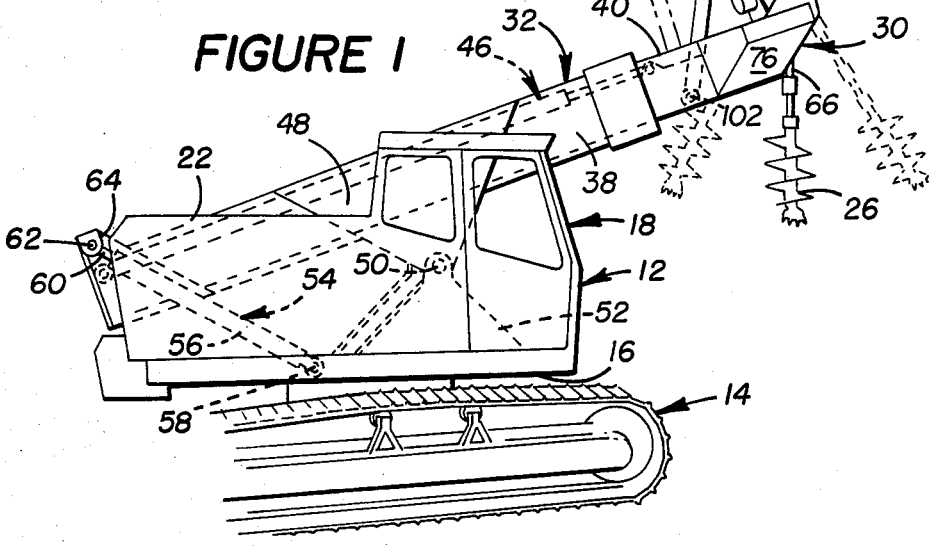

MOBILE DRILLING MACHINE

BACKGROUND OF THE INVENTION

The present invention relates to a material handling machine and more particularly to a heavy duty, mobile drilling machine or the like adapted to facilitate operation in a variety of conditions.

Many material handling implements of the type contemplated by the present invention have been disclosed in the prior art for use in a wide variety of applications. In order to adapt the implements for use in a variety of conditions and on different types of terrain, they are commonly mounted on vehicles and very often upon track laying vehicles of a type particularly suited for maneuvering in relatively inaccessible sites such as are commonly encountered in construction.

In order to better adapt such vehicles for maneuvering or positioning their implements in a wide variety of operating positions, the implements are commonly mounted on turntables permitting the implement to be positioned at any point along a 180° arc or even with a full 360° of travel about the entire circumference of the vehicle.

In addition to the variety of positions permitted by such turntables and the like, the implement may also be movably mounted upon the vehicle by means of a boom or the like with hydraulic jacks or other types of motor means being employed for adjusting the position or angular alignment of the implement.

Accordingly, it is to be understood that a mobile drilling machine or material handling implement of the type contemplated by the present invention includes many individual components common to material handling machinery in the prior art. However, it is also to be understood that with the continued use of such machinery in construction or other types of applications, further improvement in the design of the machinery is continually being sought in order to make the machinery more competitive or efficient or versatile for example.

As examples of versatility and efficiency of the type sought in connection with material handling machinery such as that contemplated by the present invention, it is noted that a vehicular mounted implement may be positioned in a construction site or the like and adapted for movement of the implement upon the vehicle to reach a number of locations without repositioning the vehicle each time. As noted above, the present invention particularly contemplates a material handling implement in the form of a mobile drilling rig adapted for drilling foundation holes or the like in construction sites and other applications. It will be immediately apparent that the efficiency and versatility of such a mobile drilling machine is greatly enhanced if the drill can be properly positioned and angularly aligned for drilling a number of such holes with the vehicle in a single position. The efficiency and versatility of the machine is even further enhanced by such maneuverability where it is necessary for the vehicle to be located in relatively cramped quarters making movement of the vehicle difficult between the drilling of the different foundation holes or the like.

It will be further apparent that, in connection with mobile drilling machines and other material handling implements having similar characteristics, operation of the implement is enhanced if additional downward force can be applied during operation. The selective application of such force necessarily facilitates and makes more efficient certain operations such as the drilling of holes and other similar material handling applications.

Accordingly, there has been found to remain a need for improvements in material handling machinery of the type contemplated by the invention for overcoming one or more problems of the type referred to above and for making such machinery even more efficient, versatile and competitive in order to enhance its value in various applications.

SUMMARY OF THE INVENTION

It is therefore an object of the invention to provide mobile material handling or drilling machinery which is adapted for overcoming one or more problems of the type outlined above and also for making the machinery more efficient and/or versatile.

It is a further object of the invention to provide a heavy duty, mobile drilling machine based on a vehicle with a rotatable turntable and a centrally open channel extending along the turntable, an elongated boom being arranged within the channel and pivotably connected to the turntable while carrying an elongated drill implement or the like at its forward end. With such a combination, the drill implement is movable into an erect position upon the boom while being maneuverable into a variety of operating positions.

The mounting of the drill implement and formation of the turntable also permits the drill implement to be moved into a transport position generally parallel with the boom, the central channel in the turntable permitting the entire mobile machine to have overall dimensions suitable for transport of the vehicle on public highways and the like without requiring disassembly of the vehicle. Thus, the invention particularly enhances versatility and efficiency of such mobile machinery in that it may be readily transported from one site to another while being in a condition to immediately recommence operation upon arriving at a subsequent site.

It is yet another object of the invention to provide a heavy duty, mobile drilling machine or the like contemplated for use in drilling foundation holes or similar applications, the machinery being based upon a vehicle including a rotatable turntable having a telescoping boom pivotably mounted upon the turntable with a drill mast interconnected to the forward end of the boom by relatively transverse pivot means permitting respective motor means to facilitate 360° adjustment of the drill mast upon the boom. With such a combination, the turntable permits the drill mast or implement to be arranged in any of a variety of operating positions along a 180° arc or even a full 360° circle about the periphery of the vehicle. At the same time, the telescoping boom permits the drill mast or implement to be moved toward or away from the vehicle while the transverse motor means further allows angular adjustment of the drill mast to permit use of the drill in any of a wide variety of operating positions.

With the boom being pivotably mounted on the turntable and adapted for operation by associated jacks or other motor means, the drill mast may be either raised or lowered relative to the vehicle in addition to the other degrees of freedom provided by the components summarized above in order to even further enhance versatility of the machine. For example, with the drill mast being movable upon the boom, rotatable by the turntable, laterally movable by the telescoping boom and angularly adjustable by its relatively transverse motor means, the drill mast can be placed in any of a wide variety of drilling alignments, even in locations either substantially above or below the terrain upon which the vehicle is situated. At the same time, movement of the drill mast in the manner summarized above further facilitates interchange or replacement of drill components or other material handling implements.

Yet another related object of the invention is to provide a heavy duty, drilling machine or the like including a material handling implement requiring substantial downward force during operation, the machine including a first boom portion adapted for pivotable mounting upon a suitable vehicle, a second boom portion being mounted in telescoping relation upon the first boom portion and adapted for pivotably mounting the implement on its forward or extended end, the second boom portion forming a chamber for receiving ballast during operation in order to increase downward force upon the implement. Through such a combination, the machine is particularly adapted for versatile operation. At the same, time formation of the ballast tank within the second telescoping boom portion facilitates the use of substantial ballast particularly during operation of the implement in order to further increase its efficiency.

Additional objects and advantages of the invention are made apparent in the following description having referenced to the accompanying drawings.

BRIEF DESCRIPTION OF THE DRAWINGS

FIG. 1 is a side view in elevation of the heavy duty, mobile drilling machine of the present invention, hidden portions of the machine being illustrated in broken lines to better illustrate its construction.

FIG. 2 is a view taken from the left side of FIG. 1 in order to better illustrate construction of the machine, movement of a drill mast upon a boom of the machine about relatively transverse pivot axes being illustrated in phantom in FIGS. 1 and 2.

FIG. 6 is a view taken generally from the left side of FIG. 4. FIG. 7 is an enlarged fragmentary view of the implement mounting end of the boom similar to FIG. 4. FIG. 5 is an enlarged fragmentary view of the opposite or hidden side of the implement mounting end of the boom as seen in FIG. 4.

DESCRIPTION OF THE PREFERRED EMBODIMENT

Figure 4:
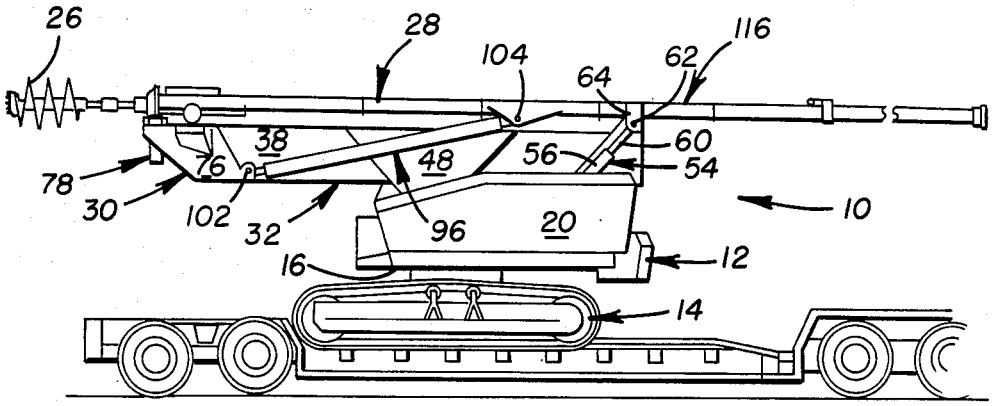
FIG. 4 is another side view in elevation of the heavy duty mobile drilling machine of the invention generally similar to the view of FIG. 1 but with the drill mast retracted into generally horizontal alignment with the boom so that overall dimensions of the machine are adapted to facilitate transport on public highways or the like without requiring disassembly.

Referring now to the drawings and particularly to FIGS. 1 and 2, a heavy duty, mobile drilling or material handling machine as contemplated by the present invention is generally indicated at 10. The machine is preferably based upon a vehicle 12 including track laying carriage means 14 and a rotatable turntable 16.

Referring particularly to FIG. 2 as well as FIG. 1, the vehicle is preferably of a type having an operator's station 18 and other vehicle components arranged in housings 20 and 22 extending along opposite sides of the turntable 16 to form an open channel 24 extending the length of the turntable.

With the vehicle preferably being adapted for hydrostatic operation, a hydrostatic pump and associated prime mover (not shown) are preferably arranged in the housing 20 opposite the housing portion including the operator's station 18. Other components conventionally arranged within the housings 20 and 22 include a hydraulic fluid tank and associated valving (not shown) as necessary for permitting hydrostatic operation of the machine 10. The hydrostatic pump referred to above and located within the housing portion 20 is adapted to provide locomotive power for the vehicle 12 through suitable and conventional drive means (not shown) while also supplying operating power for the drill or other material handling implement toward which the present invention is particularly directed.

Continuing with referenced to FIGS. 1 and 2, the heavy duty, mobile drilling machine of the present invention preferably includes an augur or drill implement 26 mounted in rotatable and longitudinally movable fashion by a drill mast 28, the construction and operation of which is described in greater detail below.

The drill mast 28 is in turn mounted upon a forward end 30 of a boom 32 by relatively transverse pivot means 34 and 36 permitting 360° angular adjustment of the drill mast upon the boom.

The boom 32 is of a telescoping type including a first or base portion 38 and a second or extendable portion 40 to which the drill mast is connected.

Figure 3:
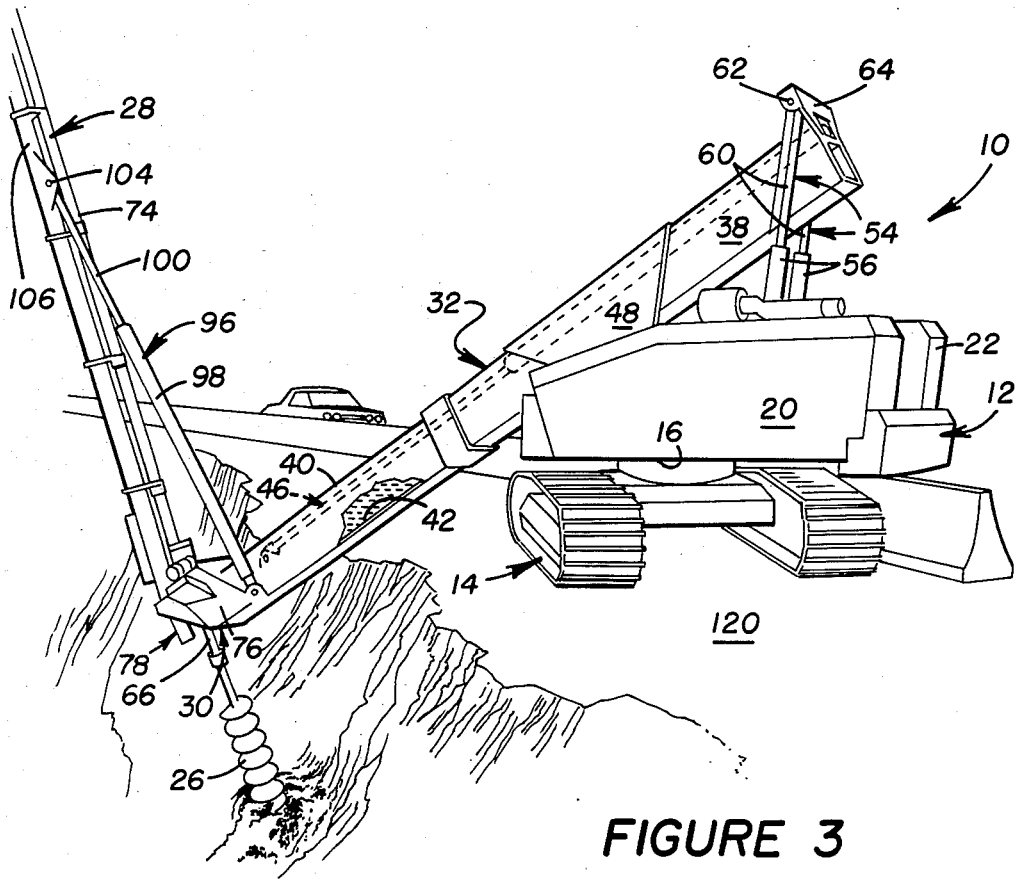
FIG. 3 is yet another view of the heavy duty mobile drilling machine with its telescoping boom fully extended and lowered to better demonstrate versatility of the machine, particularly in relatively inaccessible terrain.

Preferably, the second boom portion 40 is adapted for telescoping movement inside the first or base portion of the boom 38. Referring also to FIG. 3, the extendable boom portion 38 also forms a ballast chamber 42 along a substantial portion of its length. The chamber 42 may be filled with ballast liquid such as water through a valve 44 (see FIG. 5). If desired, the valve 44 may be interconnected with suitable pumping equipment or vehicle 12 in order to facilitate filling of the ballast chamber 42 under control from the operator station 18 if desired. An extendable and retractable hydraulic jack 46 is also arranged within the inner boom portion 40 above the water chamber 42. With the opposite ends of the jack 46 being interconnected between the first and second boom portions 38 and 40, it will be apparent that operation of the jack 46 from the operator station 18 serves to extend and retract the telescoping boom 32.

Referring again particularly to FIGS. 1 and 2, a central reinforced portion 48 of the telescoping boom 32 is pivotably mounted at 50 upon the turntable 16 by means of a bracket 52. As may be best seen in FIGS. 1 and 2, both the reinforcement plates 48 and the bracket 52 are bifurcated in order to provide substantial pivotable support for the boom as indicated at 50.

Motor means for operating the boom 32 upon the pivot 50 preferably comprises a pair of hydraulic jacks 54 each having a cylinder 56 pivotably interconnected with the turntable at 58 and an extendable and retractable rod 60 pivotably interconnected at 62 with an upwardly projecting portion 64 at the rearward end of the first boom portion 38. With the jacks 54 fully retracted as illustrated in FIG. 1, the forward end of the boom and the drill mast 28 is raised to a generally maximum height above the ground. Similarly, with the jacks 54 fully extended, as generally indicated in FIG. 3, the drill mast is moved closely adjacent the ground. It will be apparent both in connection with FIGS. 1 and 3 that the actual height of the drill mast relative to the ground depends not only upon the condition of the jacks 54 but also upon the telescoped position of the boom. For example, with the telescoping boom being fully retracted as illustrated in FIG. 1, it would of course be possible for the drill mast 28 to be raised even further above the level of the ground on which the vehicle 12 is positioned by extension of the jack 46. The jack 46 is illustrated in an extended position in FIG. 3 in order to permit the forward end of the boom, upon which the drill mast 28 is mounted, to be extended substantially below the ground level on which the vehicle 12 is positioned in order to further enhance the operating ability and versatility of the machine.

Continuing with reference to FIGS. 1 and 2, it may be seen that the boom 32 is positioned within the open channel 24 formed between the housing portions 20 and 22. Preferably, the pivotable mounting 50 for the boom 32 is positioned substantially above the level of the turntable 16 by means of the bracket 52. With the boom jacks 54 being interconnected between the pivot points 58 adjacent the turntable level 12 and adjacent an upper portion of the boom as indicated at 62, a teeter or see-saw-like configuration is provided for the boom permitting maximum elevation and lowering of the drill mast by retraction and extension respectively of the jacks 54.

Before turning to the construction of the drill mast 28 and the manner in which it is mounted upon the second boom portion 40, it is noted that both the first and second boom portions 38 and 40 are of fabricated, box-like construction in order to provide maximum strength and to facilitate the telescoping relation of those parts.

Figures 5, 6, 7:
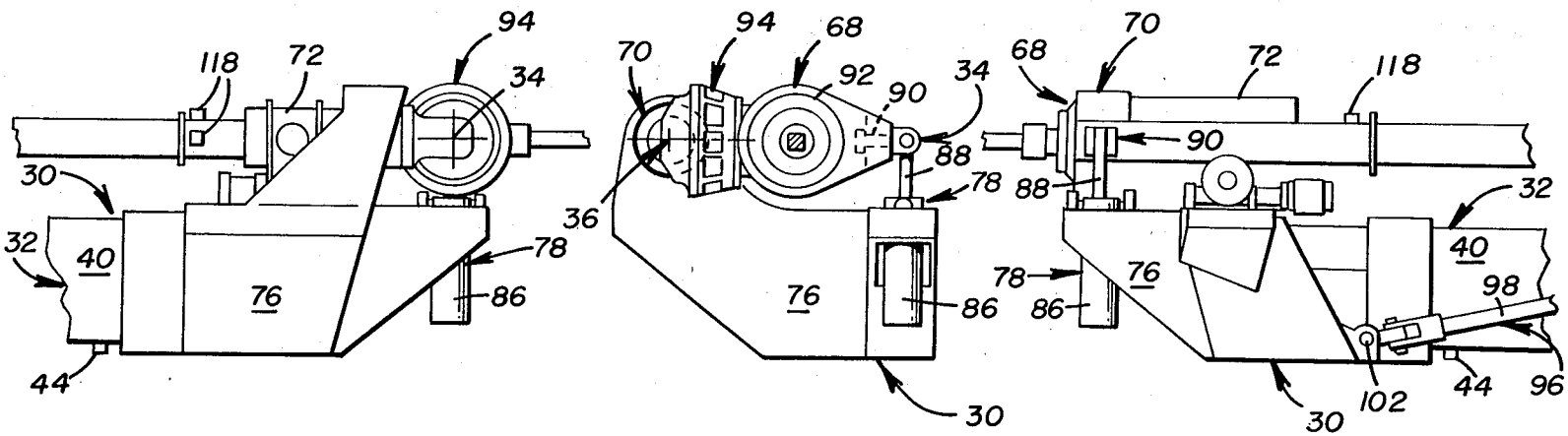
FIGS. 5–7 are further enlarged fragmentary views of an outer end of the boom adapted for mounting the drill mast, the drill mast being illustrated in each of those figures in a position generally similar to that of FIG. 4.

Referring particularly to FIGS. 5–7 as well as FIG. 1, it is noted that the augur 26 is mounted upon a Kelly bar 66 which passes in meshing relation through a final drive unit 68. The final drive 68 is in turn coupled with a right angle drive unit 70 which is driven by a hydrostatic motor 72. The hydrostatic motor 72 is in turn coupled with the hydrostatic pump in the housing 20 as described above by hose or the like in conventional fashion. The hose interconnecting the hydrostatic pump and motor is omitted from the drawings in order to better illustrate the construction and operation of the drill mast 28 and associated components.

The Kelly bar 66 extends upwardly to form an extendable and retractable rod portion for a hydraulic cylinder 74. Thus, extension and retraction of the Kelly bar 66 by the cylinder 74 serves to lower and raise the augur 26 while the augur is driven in rotation by the final drive unit 68 in the manner described immediately above.

Referring particularly to FIG. 6, the second boom portion 40 is formed with an enlarged equipment deck 76 for mounting the drill mast 28 and associated components. The manner in which the drill mast 28 is mounted upon the equipment deck 76 while being adapted for angular movement about the transfer's pivot 34 and 36 is described immediately below. A tilt jack 78 is interconnected between the equipment deck 76 and the drill mast 28 in order to adjust the mast 28 from its central position illustrated in solid lines at 80 in FIG. 2 either to the left or right as illustrated in phantom at 82 and 84 with the mast being capable of angle adjustment approximately 15° from its center position 80 to either its left position or its right position 84, an overall angling adjustment of about 30° is thus possible for the mast.

Referring again to FIGS. 5–7, the tilt jack 78 includes a cylinder 86 which is connected to the equipment deck 76. The tilt jack 78 also includes a rod 88 which is extendable and retractable within the cylinder 86 while being trunnion mounted at 90 to a housing 92 for the final drive unit 68.

Referring again particularly to FIG. 6, it may also be seen that a relatively rotatable coupling 94 interconnects the final drive unit 68 and the right angle drive unit 70.

Referring momentarily to FIG. 1 and FIG. 7, an angling jack 96 includes a cylinder 98 and extendable and retractable rod 100. The cylinder 98 is pivotably connected at 102 to the equipment deck 76 while the rod 100 is pivotably connected at 104 to a reinforcing bar 106 arranged alongside the cylinder 74 of the drill mast. The reinforcing bar 106 is interconnected along its length with the cylinder 74 as indicated at 108.

With the angling jack 96 thus interconnected between the boom 32 and the drill mast 28, it may be seen that with the rod 100 partially extended from the cylinder 98 as illustrated in solid lines in FIG. 1, the drill mast 28 is in a generally erect position. With the rod 100 being fully extended from the cylinder 98 of the angling jack, the drill mast 28 is shifted forwardly approximately an additional 30° into an overcenter position as generally indicated in phantom at 112. Similarly, the rod 100 of the angling jack 96 may be somewhat retracted from the solid line position illustrated at 110 into an additional phantom position generally indicated at 114. However, with the rod 100 of the angling jack 96 being fully retracted, the drill mast 28 is shifted into a position 116 as illustrated in FIG. 4 where the drill mast 28 is generally parallel with the boom 32 in order to place the machine 10 in a transport condition as will be described in greater detail below.

Referring again to FIGS. 5–7 as well as FIGS. 1 and 2, it may be seen that the transverse pivots 34 and 36 are formed respectively by the right angle drive unit 70 and the combination of the rotatable coupling 94 and the trunnion mounting 90 arranged on opposite sides of the final drive 68. In other words, with the drill mast 28 in the generally erect position illustrated in FIG. 2, extension of the tilt jack 78 causes the drill mast 28 to be shifted toward the rightmost phantom position 84 illustrated in FIG. 2. Similarly, retraction of the tilt jack 78 causes the drill mast 28 to be shifted toward the left phantom position 82 as viewed in FIG. 2. The right angle drive unit 70 provides the axis 32 for this pivotable motion of the drill mast 28 while maintaining proper driving engagement with the final drive unit 68.

Similarly, extension and retraction of the angling jack 96 causes the drill mast to rotate about the axis 34 formed by the trunnion mounting 90 and the rotatable coupling 94. Referring momentarily to FIGS. 1 and 3, movement of the drill mast 28 about the pivot axis 34 permits movement of the drill mast from the solid line position 110 in FIG. 1 to either of the phantom positions 112 and 114 of FIG. 1 as well as the parallel position 116 of FIG. 3. Thus, it is apparent that by respective or joint operation of the tilt and angling jacks 78 and 96, 360° adjustment of the drill mast 28 about its generally erect position is illustrated for example at 110 in FIG. 1 is possible.

In certain applications, it is desirable for the operator of the machine 10 to be able to precisely determine when the drill mast 28 is in a perpendicular position. In order to permit such regulation, means are provided on the drill mast 28 such as the mercury switches 118 properly interconnected with the operator station 18. With the mercury switch components 118 being arranged approximately 90° from each other upon the mast unit 28, they can be monitored by the operator of the machine to determine when the drill mast 28 is in a perpendicular position. Through such as arrangement or by similar means, the operator is also able to determine when the drill mast is in any desired angular alignment. For example, referring momentarily to FIG. 3, it may be desirable to drill foundation holes or the like beneath the roadway indicated at 120 at a precise predetermined angle. Such control is made possible through the switch means 118.

The ballast in the tank 42 is preferably a drilling fluid to facilitate operation of the drilling operation. For example, water from the tank can be used when drilling in rock or similar hard material. The water serves as a coolant and also as a binder for removal of drilling fragments from the drill hole. The boom and/or drill mast preferably comprise means (not shown) for delivering the fluid to the auger or drill hole.

Operation of the machine 10 is believed apparent from the preceding description. However, the method of operation for the machine is described briefly below in order to assure a complete understanding of the invention.

With the machine 10 located in a preferred site such as that indicated at FIG. 3, the drill mast 28 is raised to its generally erect position by the angling jack 96. The augur 26 of the drill implement 28 is then positioned precisely at the point where a hole is to be drilled by combined operation of the turntable 16, the boom jacks 54 and the telescoping jack 46. With the drill unit thus properly positioned, its angular alignment is precisely adjusted by means of joint operation of the tilt and angling jacks 78 and 96 in the manner described above. With the drill unit thus properly positioned, it may be operated in rotation through the final drive 68 and by extension of the Kelly bar 66 from the cylinder 74. At the same time, water or other ballast is preferably introduced into the chamber 42 in order to provide additional downward force on the drill unit in order to further facilitate its operation.

Upon the completion of each drill hole, the drill unit can then be rapidly repositioned by combined operation of the various components referred to above in order to position the drill unit in any preferred angular alignment at any point about the vehicle as permitted by the turntable 16. Because of the telescoping nature of the boom 32, the drill point may also be selected at a variable distance from the vehicle. In addition to permitting drilling of holes substantially beneath the terrain upon which the vehicle is located as illustrated in FIG. 3, it is also possible to drill holes at any predetermined angular alignment at a level substantially above the terrain upon which the vehicle is positioned.

When drilling is completed in any particular site such as that illustrated in FIG. 3, the transport weight of the vehicle may be substantially reduced by emptying the water or other ballast from the chamber 42. The drill mast 28 is then retracted into the position 116 as illustrated in FIG. 4 so that the boom 32 and drill mast 28 are arranged generally within the open channel 24 of the vehicle. This configuration novelly permits the overall height of the machine to be maintained within a maximum permitted for travel on public highways and the like. Thus, the machine 10 may be placed in a transport condition as illustrated in FIG. 4 for movement to a new working site without requiring disasssembly of the mast, boom or other components. The machine is then ready for use immediately upon arrival at the new site.

Thus, there has been disclosed a novel heavy duty, mobile drill machine or the like for use in drilling foundation holes or other applications. Various modifications are believed obvious in addition to those described above. Accordingly the scope of the present invention is defined only by the following appended claims.

What is claimed is:

1. A heavy duty, mobile drilling machine, comprising a vehicle with a rotatable turntable, housing means for an operator station and other vehicle components mounted on said turntable and including a boom disposed thereon, said boom comprising a telescoping portion, bracket means providing a pivotal mounting for said boom on a forward portion of said turntable, motor means for pivotally operating said boom, said motor means being interconnected between said boom rearwardly of said pivotal mounting and said turntable, and an elongated drill implement pivotally interconnected to a forward end of said boom telescoping portion permitting movement of said drill implement into an erect position on said boom, said drill implement being mounted on said forward end of said boom by relatively transverse pivot means for facilitating 360° adjustment of said drill element on said boom and said boom being pivotal on said turntable by said motor means for facilitating operation of said drill implement, said drill implement also being movable into a transport position generally parallel with said boom to facilitate transport without disassembly, the arrangement of said motor means and pivotal mounting for said boom and the arrangement of said boom permitting maximum elevation and lowering of said drill implement on said boom, said telescoping portion of said boom further comprises means within said telescoping portion adapted for receiving ballast in order to selectively increase effective mass of said drill implement during operation.

2. The drilling machine of claim 1 wherein the housing means has an open channel extending therethrough with the boom disposed therein.

3. The drilling machine of claim 2 wherein the channel is centrally disposed through said housing means.

4. The machine of claim 3 wherein said ballast means comprises a chamber formed within said telescoping boom portion and further comprising means for filling said chamber with ballast.

5. The method of claim 4 wherein the ballast is a drilling fluid for facilitating the drilling operation.

6. The machine of claim 4 wherein respective motor means are provided for positioning said drill implement relative to said transverse pivot means.

7. The machine of claim 1 wherein said pivotable mounting for said boom is formed in spaced apart relation above said turntable by said bracket means, said motor means for pivotably operating said boom being interconnected with said turntable at a point substantially lower than said pivotable mounting for said boom.

8. The machine of claim 1 wherein said drill implement comprises an elongated mast and motor means secured to said mast for raising and lowering a rotatable auger.

9. The machine of claim 8 wherein said vehicle comprises hydrostatic means for supplying locomotive power for the vehicle and for driving said auger in rotation.

* * * * *

UNITED STATES PATENT AND TRADEMARK OFFICE

CERTIFICATE OF CORRECTION

PATENT NO. : 4,627,499

DATED : December 9, 1986

INVENTOR(S) : William E. Magee et al.

It is certified that error appears in the above-identified patent and that said Letters Patent is hereby corrected as shown below:

Column 4, line 44, "or" should read -- on --.

Column 8, line 56, "claim 3" should read -- claim 1 --.

Signed and Sealed this

Thirty-first Day of March, 1987

*Attest:*

DONALD J. QUIGG

*Attesting Officer*

*Commissioner of Patents and Trademarks*